US011189418B2

(12) United States Patent
Komachi et al.

(10) Patent No.: US 11,189,418 B2
(45) Date of Patent: Nov. 30, 2021

(54) COIL COMPONENT

(71) Applicant: TDK CORPORATION, Tokyo (JP)

(72) Inventors: Toshifumi Komachi, Tokyo (JP); Kosuke Kunitsuka, Tokyo (JP); Toshio Tomonari, Tokyo (JP)

(73) Assignee: TDK CORPORATION, Tokyo (JP)

( * ) Notice: Subject to any disclaimer, the term of this patent is extended or adjusted under 35 U.S.C. 154(b) by 399 days.

(21) Appl. No.: 16/004,759

(22) Filed: Jun. 11, 2018

(65) Prior Publication Data

US 2018/0358174 A1 Dec. 13, 2018

(30) Foreign Application Priority Data

Jun. 13, 2017 (JP) ..... JP2017-115958

(51) Int. Cl.

| | |
|---|---|
| ***H01F 27/34*** | (2006.01) |
| ***H01F 17/00*** | (2006.01) |
| ***H01F 27/28*** | (2006.01) |
| ***H01F 27/24*** | (2006.01) |
| ***H01F 27/06*** | (2006.01) |
| ***H01F 27/29*** | (2006.01) |
| ***H01F 17/04*** | (2006.01) |

(52) U.S. Cl.

CPC ..... *H01F 27/34* (2013.01); *H01F 17/0013* (2013.01); *H01F 17/04* (2013.01); *H01F 27/06* (2013.01); *H01F 27/24* (2013.01); *H01F 27/2804* (2013.01); *H01F 27/29* (2013.01); *H01F 2017/0046* (2013.01); *H01F 2017/0073* (2013.01); *H01F 2027/2809* (2013.01)

(58) Field of Classification Search

CPC ..... H01F 27/34; H01F 17/0013

See application file for complete search history.

(56) References Cited

U.S. PATENT DOCUMENTS

2001/0040270 A1* 11/2001 Kobayashi ..... H01F 17/0006 257/531
2003/0030532 A1* 2/2003 Iida ..... H01F 17/0006 336/200
2003/0179067 A1 9/2003 Gamou et al.
(Continued)

FOREIGN PATENT DOCUMENTS

GB 2083952 A 3/1982
JP 6-236821 A 8/1984
(Continued)

*Primary Examiner* — Elvin G Enad
*Assistant Examiner* — Malcolm Barnes
(74) *Attorney, Agent, or Firm* — Young Law Firm, P.C.

(57) ABSTRACT

Disclosed herein is a coil component that includes first and second coil parts each spirally wound in a plurality of turns in directions opposite to each other. An innermost turn of the first coil part is radially divided into first and second conductor parts by a spiral slit, and at least an innermost turn of the second coil part is radially divided into third and fourth conductor parts by a spiral slit. The first conductor part is positioned radially inward of the second conductor part, and the third conductor part is positioned radially inward of the fourth conductor part. The inner peripheral end of the first conductor part is connected to the inner peripheral end of the fourth conductor part, and the inner peripheral end of the second conductor part is connected to the inner peripheral end of the third conductor part.

18 Claims, 7 Drawing Sheets

(56) References Cited

U.S. PATENT DOCUMENTS

| | | | | |
|---|---|---|---|---|
| 2005/0156700 | A1* | 7/2005 | Chang | H01F 17/0006 336/200 |
| 2011/0050380 | A1* | 3/2011 | Nakanishi | H01F 27/341 336/200 |
| 2011/0102121 | A1* | 5/2011 | Otsuka | H01F 27/06 336/192 |
| 2011/0102125 | A1 | 5/2011 | Tamura et al. | |
| 2013/0328164 | A1* | 12/2013 | Cheng | H01L 28/10 257/531 |
| 2014/0021794 | A1* | 1/2014 | Kim | H01F 38/14 307/104 |
| 2015/0145635 | A1* | 5/2015 | Kurz | H02J 7/025 336/232 |
| 2015/0180128 | A1* | 6/2015 | Ishikura | H01Q 1/2225 343/788 |
| 2015/0364248 | A1* | 12/2015 | Groves | H01F 41/04 336/232 |
| 2016/0094082 | A1 | 3/2016 | Ookawa et al. | |
| 2016/0126001 | A1* | 5/2016 | Chien | H02J 50/005 336/200 |
| 2016/0155558 | A1* | 6/2016 | Groves | H01F 17/0006 336/200 |
| 2017/0040107 | A1* | 2/2017 | Peralta | H02J 7/025 |

FOREIGN PATENT DOCUMENTS

| | | | | |
|---|---|---|---|---|
| JP | 06236821 | A | * | 8/1994 |
| JP | 2001319813 | A | | 11/2001 |
| JP | 2013-78234 | A | | 4/2013 |
| JP | 2013251455 | A | | 12/2013 |

* cited by examiner

COIL COMPONENT

BACKGROUND OF THE INVENTION

Field of the Invention

The present invention relates to a coil component and, more particularly, to a coil component having a spiral planar conductor.

Description of Related Art

As coil components used for various electronic devices, there are known coil components of a type in which a wire (coated conductive wire) is wound around a magnetic core and of a type in which a spiral planar conductor having a plurality of turns is formed on a surface of an insulating layer. For example, JP 2013-251455 A discloses a coil component having a configuration in which spiral planar conductors formed on different insulating layers are connected to each other at their inner peripheral ends or outer peripheral ends.

To reduce DC resistance and AC resistance in a coil component including a spiral planar conductor, the width of the spiral planar conductor may be made large.

However, simply making the width of the planar conductor large increases unevenness of a current density distribution and thus cannot reduce DC resistance and AC resistance sufficiently. As described in JP 2001-319813 A, to make the current density distribution more even, a method of dividing each turn of a planar conductor into a plurality of parts by spiral slits can be adopted. In this case, however, a difference may occur in the current density distribution between the inner and outer peripheral sides of the planar conductor constituting the same turn.

SUMMARY

It is therefore an object of the present invention to provide a coil component in which DC resistance and AC resistance can be reduced and in which a difference in current density distribution between an inner peripheral side conductor part and an outer peripheral side conductor part is eliminated so as to make the current density distribution even.

A coil component according to the present invention includes a first coil part spirally wound in a plurality of turns and a second coil part laid so as to overlap the first coil part and spirally wound in a plurality of turns in the direction opposite to the winding direction of the first coil part. At least the innermost turn of the first coil part is radially divided into first and second conductor parts by a spiral slit, and at least the innermost turn of the second coil part is radially divided into third and fourth conductor parts by a spiral slit. The first conductor part is positioned radially inward of the second conductor part, and the third conductor part is positioned radially inward of the fourth conductor part. The inner peripheral end of the first conductor part is connected to the inner peripheral end of the fourth conductor part, and the inner peripheral end of the second conductor part is connected to the inner peripheral end of the third conductor part.

According to the present invention, at least the innermost turn of each of the first and second coil parts is radially divided by the spiral slit, so that unevenness of a current density distribution can be reduced to thereby allow reduction in DC resistance and AC resistance. In addition, the first conductor part positioned on the inner peripheral side is connected to the fourth conductor part positioned on the outer peripheral side, and the second conductor part positioned on the outer peripheral side is connected to the third conductor part positioned on the inner peripheral side, so that a difference in current density between inner and outer peripheries is eliminated. This makes the current density distribution more even, allowing further reduction in DC resistance and AC resistance.

In the present invention, the turns of the first coil part including the innermost turn may each be divided into the first and second conductor parts by the slit, and the turns of the second coil part including the innermost turn may each be divided into the third and fourth conductor parts by the slit. With this configuration, unevenness of the current density distribution is further reduced to thereby allow further reduction in DC resistance and AC resistance.

In the present invention, the first to fourth conductor parts each have a circumferential area in which the radial position of the conductor is not shifted and a transition area in which the radial position of the conductor is shifted. The circumferential area of the first conductor part and the circumferential area of the third conductor part may overlap each other, and the circumferential area of the second conductor part and the circumferential area of the fourth conductor part may overlap each other. This facilitates pattern design of the first and second coil parts.

The coil component according to the present invention may further include an insulating film. The first coil part may be formed on one surface of the insulating film, and the second coil part may be formed on the other surface of the insulating film. The inner peripheral end of the first conductor part and the inner peripheral end of the fourth conductor part may be connected to each other through a first through hole conductor formed so as to penetrate the insulating film, and the inner peripheral end of the second conductor part and the inner peripheral end of the third conductor part may be connected to each other through a second through hole conductor formed so as to penetrate the insulating film. This facilitates the manufacture of the coil component. In this case, the coil component according to the present invention may further include a magnetic member having a protruding part, the insulating film may have a through hole formed at a portion corresponding to the inner diameter area of each of the first and second coil parts, and the protruding part of the magnetic member may be inserted through the through hole of the insulating film. With this configuration, high inductance can be obtained.

The coil component according to the present invention may include a plurality of sets each including the first coil part and second coil part are provided, and the plurality of sets may be connected in parallel. With this configuration, DC resistance and AC resistance can be further reduced.

Thus, according to the present invention, it is possible to reduce DC resistance and AC resistance and eliminate a difference in current density distribution between the inner peripheral side conductor part and the outer peripheral side conductor part to thereby make the current density distribution even.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

First Embodiment

Figure 1:
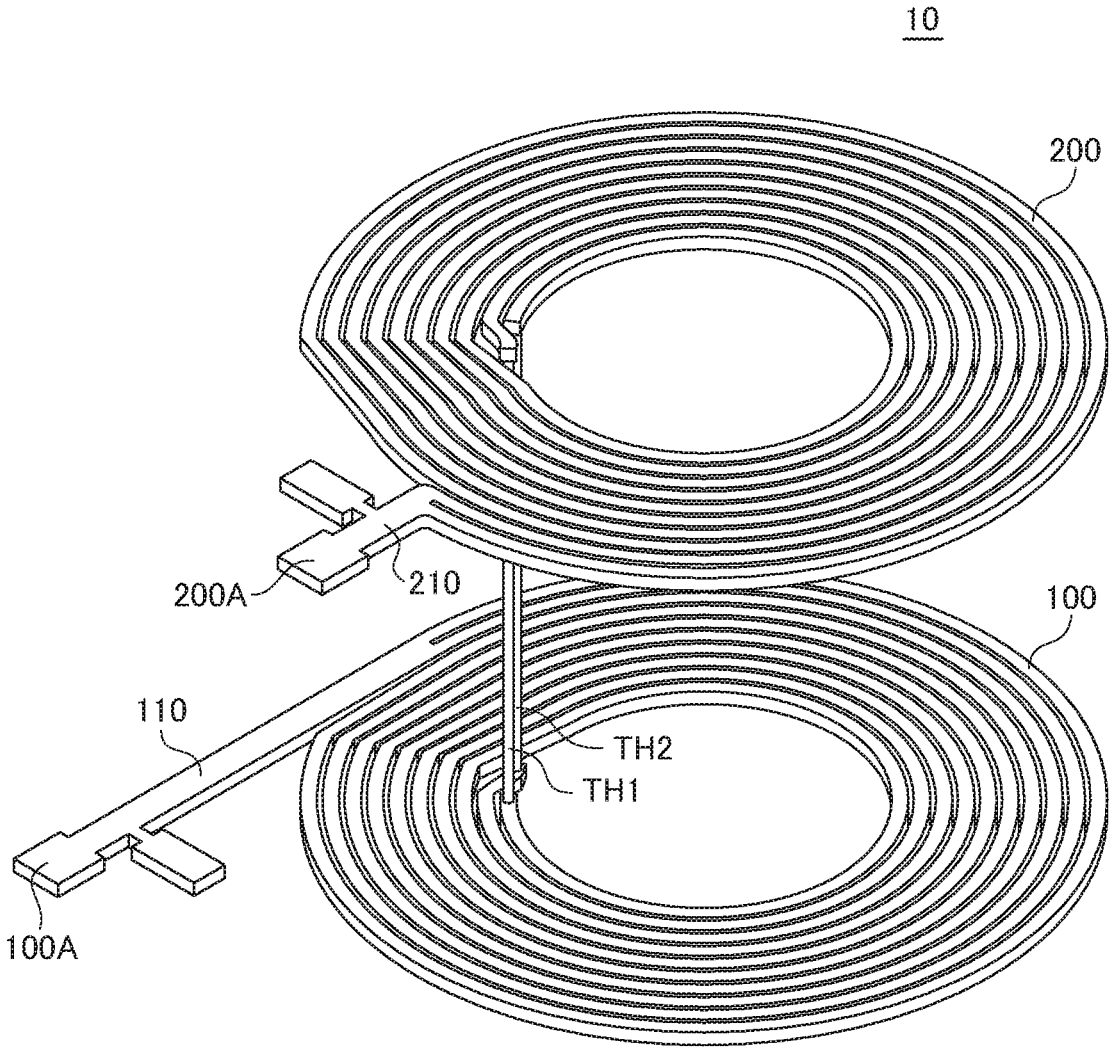
FIG. 1 is a schematic perspective view for explaining the structure of the main part of a coil component according to a first embodiment of the present invention.
Figure 2:
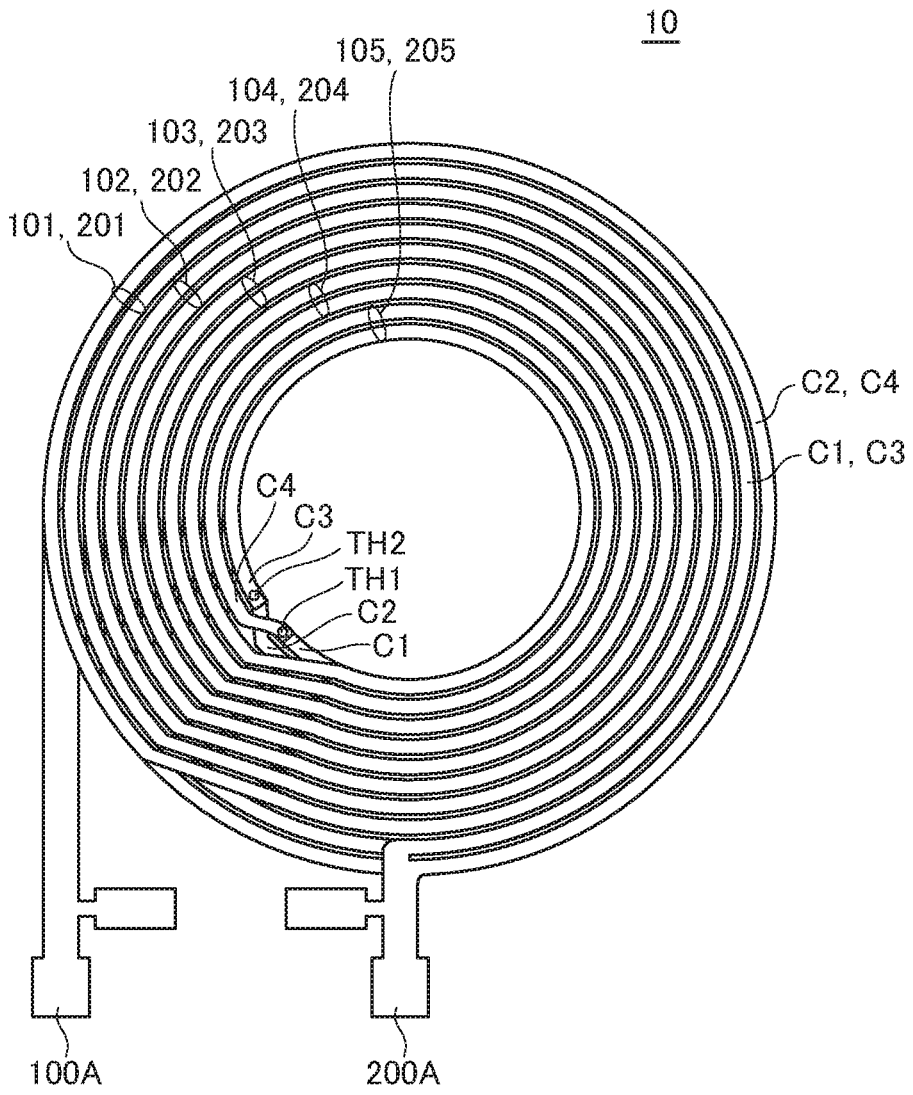
FIG. 2 is a plan view of the coil component shown in FIG. 1.

FIG. 1 is a schematic perspective view for explaining the structure of the main part of a coil component 10 according to the first embodiment of the present invention. FIG. 2 is a plan view of the coil component 10.

As illustrated in FIGS. 1 and 2, the coil component 10 according to the present embodiment has a first coil part 100 and a second coil part 200 which are laid to overlap each other.

The first and second coil parts 100 and 200 are each constituted by a spiral planar conductor spirally wound in a plurality of turns. The winding directions of the first coil part 100 and second coil part 200 are opposite to each other. Specifically, assuming that the outer peripheral end of the coil part is the starting point, the first coil part 100 is wound in the clockwise direction (right-handed direction), while the second coil part 200 is wound in the counterclockwise direction (left-handed direction). The inner peripheral end of the first coil part 100 and that of the second coil part 200 are connected to each other through first and second through hole conductors TH1 and TH2, thereby constituting one coil.

Figure 3B:
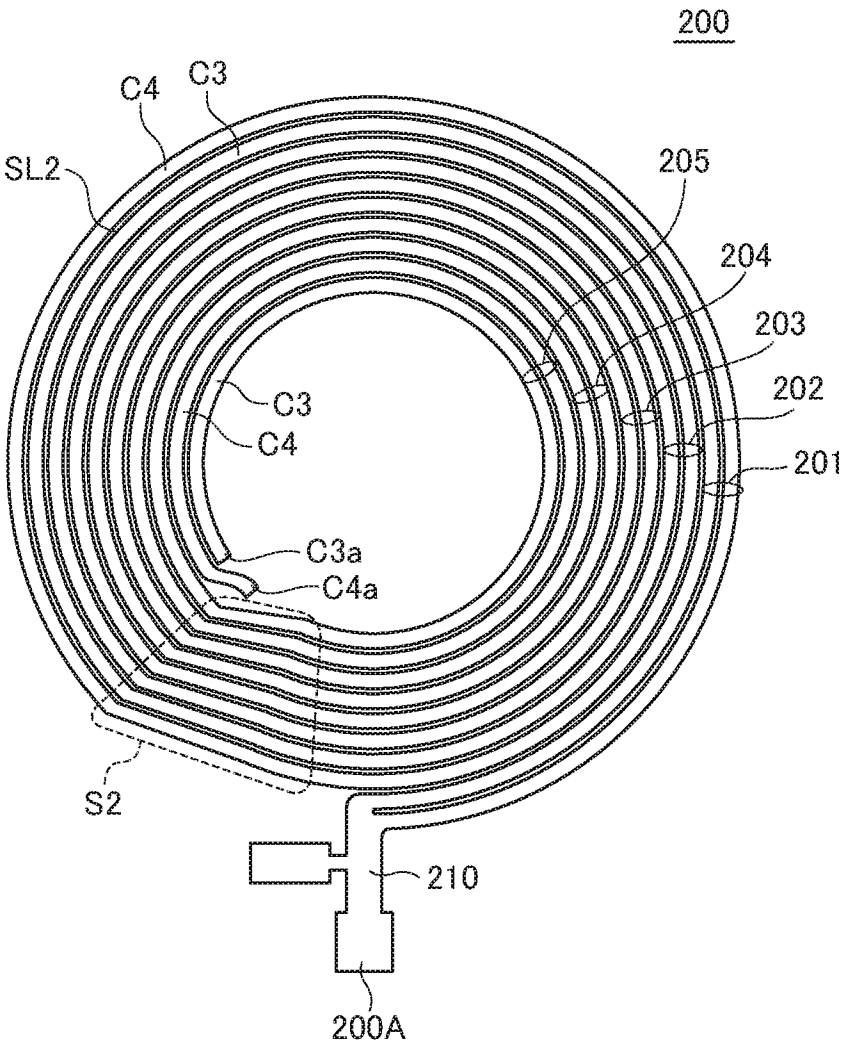
FIG. 3B is a plan view of a second coil part.
Figure 3A:
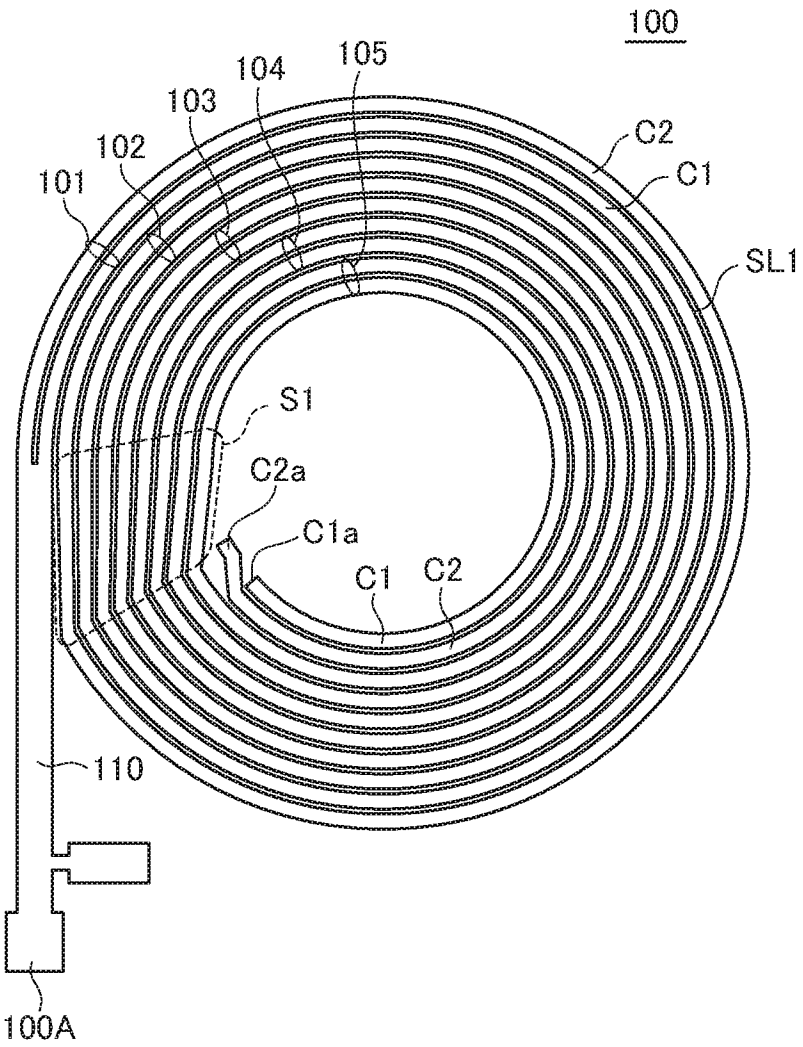
FIG. 3A is a plan view of a first coil part.

FIG. 3A is a plan view of the first coil part 100, and FIG. 3B is a plan view of the second coil part 200.

As illustrated in FIG. 3A, the first coil part 100 is constituted by a spiral planar conductor spirally wound in five turns. Turns 101 to 105 constituting the first coil part 100 each have a slit SL1, by which the turns 101 to 105 are each radially divided into first and second conductor parts C1 and C2. In the same turn, the first conductor part C1 is positioned radially inward of the second conductor part C2.

The spiral planar conductor constituting the first coil part 100 has a transition area S1 in which the radial position of the conductor is shifted, and the five turns constituted of the first turn 101 to fifth turn 105 are defined with the transition area S1 as a boundary. The first turn 101 is the outermost turn, and the fifth turn 105 is the innermost turn. A part of each of the turns 101 to 105 other than the transition area S1 is a circumferential area in which the radial position of the conductor is not shifted. The end portion of the first turn 101 constitutes the outer peripheral end of the first coil part 100, and the end portion of the fifth turn 105 constitutes the inner peripheral end of the first coil part 100. The outer peripheral end of the first coil part 100 is connected to a terminal electrode 100A through a lead-out pattern 110. The lead-out pattern 110 does not have the slit.

As illustrated in FIG. 3B, the second coil part 200 is constituted by a spiral planar conductor spirally wound in five turns. Turns 201 to 205 constituting the second coil part 200 each have a spiral slit SL2, by which the turns 201 to 205 are each radially divided into third and fourth conductor parts C3 and C4. In the same turn, the third conductor part C3 is positioned radially inward of the fourth conductor part C4.

The spiral planar conductor constituting the second coil part 200 has a transition area S2 in which the radial position of the conductor is shifted, and the five turns constituted of the first turn 201 to fifth turn 205 are defined with the transition area S2 as a boundary. The first turn 201 is the outermost turn, and the fifth turn 205 is the innermost turn. A part of each of the turns 201 to 205 other than the transition area S2 is a circumferential area in which the radial position of the conductor is not shifted. The end portion of the first turn 201 constitutes the outer peripheral end of the second coil part 200, and the end portion of the fifth turn 205 constitutes the inner peripheral end of the second coil part 200. The outer peripheral end of the second coil part 200 is connected to a terminal electrode 200A through a lead-out pattern 210. The lead-out pattern 210 does not have the slit.

As described above, in the present embodiment, the turns constituting the coil part (first and second coil part 100 or 200) are each radially divided by the slit (slit SL1 or SL2), so that as compared with a case where such a slit is not formed, unevenness of a current density distribution is reduced. As a result, DC resistance and AC resistance can be reduced.

In the present embodiment, as illustrated in FIG. 2, the circumferential area of the first conductor part C1 and that of the third conductor part C3 overlap each other as viewed in the lamination direction. Similarly, the circumferential area of the second conductor part C2 and that of the fourth conductor part C4 overlap each other as viewed in the lamination direction. In the present invention, the above configuration is not essential, but facilitates pattern design of the first and second coil parts 100 and 200.

An inner peripheral end C1*a* of the first conductor part C1 included in the first coil part 100 is connected to an inner peripheral end C4*a* of the fourth conductor part C4 included in the second coil part 200 through the first through hole conductor TH1. Further, an inner peripheral end C2*a* of the second conductor part C2 included in the first coil part 100 is connected to an inner peripheral end C3*a* of the third conductor part C3 included in the second coil part 200 through the second through hole conductor TH2.

Figure 4:
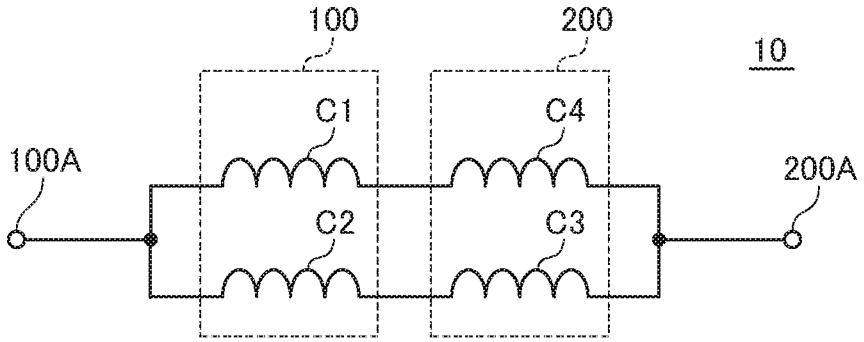
FIG. 4 is an equivalent circuit diagram of the coil component shown in FIG. 1.

With the above configuration, as illustrated in FIG. 4, the first and second coil parts 100 and 200 function as two serially-connected coils. The total number of turns is 10. One end of the serially-connected coils is the terminal electrode 100A, and the other end thereof is the terminal electrode 200A. As described above, the first coil part 100 is divided into the first and second conductor parts C1 and C2, and the second coil part 200 is divided into the third and fourth conductor parts C3 and C4. In the present embodiment, the first conductor part C1 positioned on the inner peripheral side and the fourth conductor part C4 positioned on the outer peripheral side are connected to each other, and the second conductor part C2 positioned on the outer peripheral side and the third conductor part C3 positioned on the inner peripheral side are connected to each other, so that a difference in dimension between inner and outer peripheries is eliminated. This makes the current density distribution more even, allowing further reduction in DC resistance and AC resistance.

Figure 5:
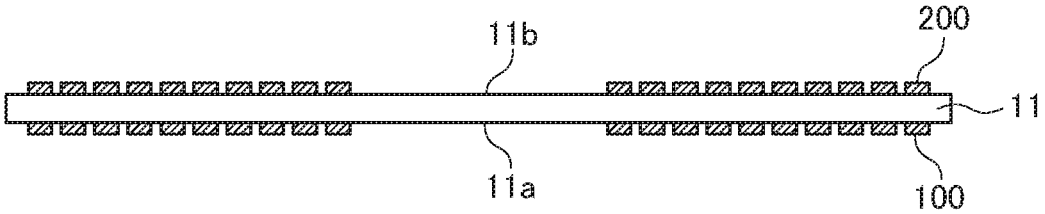
FIG. 5 is a cross-sectional view of the coil component shown in FIG. 1.

FIG. 5 is a cross-sectional view of the coil component 10.

As illustrated in FIG. 5, in the coil component 10 according to the present embodiment, the first coil part 100 is formed on one surface 11*a* of an insulating film 11 made of PET resin or the like, and the second coil part 200 is formed on the other surface 11*b* of the insulating film 11. Although not illustrated, the first and second through hole conductors TH1 and TH2 penetrate the insulating film 11. By thus disposing the first and second coil parts 100 and 200 on the front and back surfaces of the insulating film 11, the first and second coil parts 100 and 200 can be formed simultaneously. Further, by molding the front and back surfaces of the insulating film 11 with a resin material or the like so as to cover the first and second coil parts 100 and 200, the first and second coil parts 100 and 200 can be protected. The mold material may be a magnetic material having a sufficient insulating property.

Figure 6:
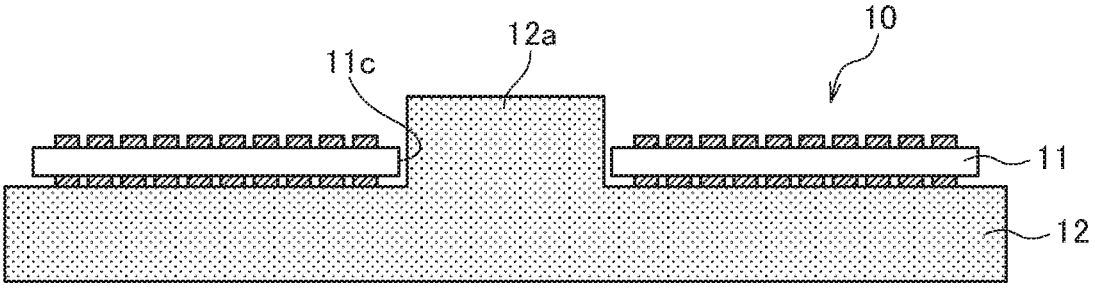
FIG. 6 is a cross-sectional view of a modification in which a magnetic member is added.
Figure 7A:
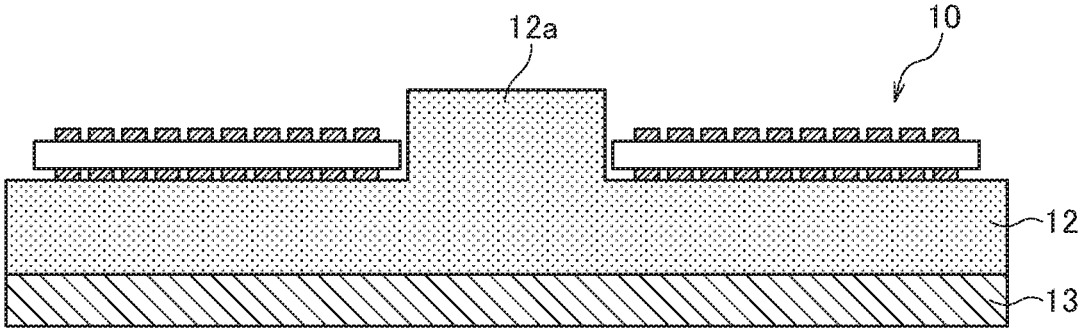
FIGS. 7A and 7B are cross-sectional view of another modification in which another magnetic member is further added.
Figure 7B:
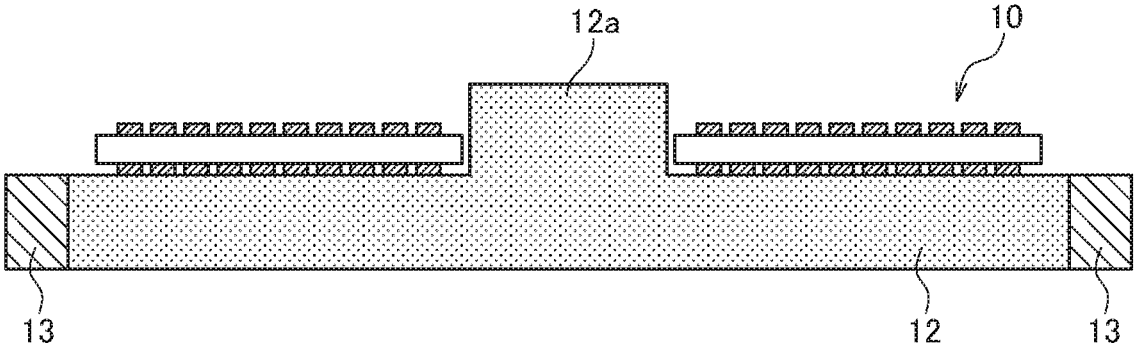

Further, it is possible to place the insulating film 11 having the first and second coil parts 100 and 200 on the front and back surfaces thereof on a substrate which is a magnetic member. In this case, as illustrated in FIG. 6, a through hole 11*c* is formed in a center portion of the insulating film 11, i.e., a portion corresponding to the inner diameter area of each of the first and second coil parts 100 and 200, and a protruding part 12*a* of a magnetic member 12 as the substrate is inserted through the through hole 11*c* of the insulating film 11, whereby high inductance can be obtained. In this case, as illustrated in FIGS. 7A and 7B, another magnetic member 13 made of a material having a larger imaginary part (μ") of complex permeability than a material constituting the magnetic member 12 may be provided on the bottom surface or side surface of the magnetic member 12. With this configuration, leakage of magnetic flux to the outside is reduced, thereby allowing influence on other adjacent components to be reduced.

Second Embodiment

Figure 8:
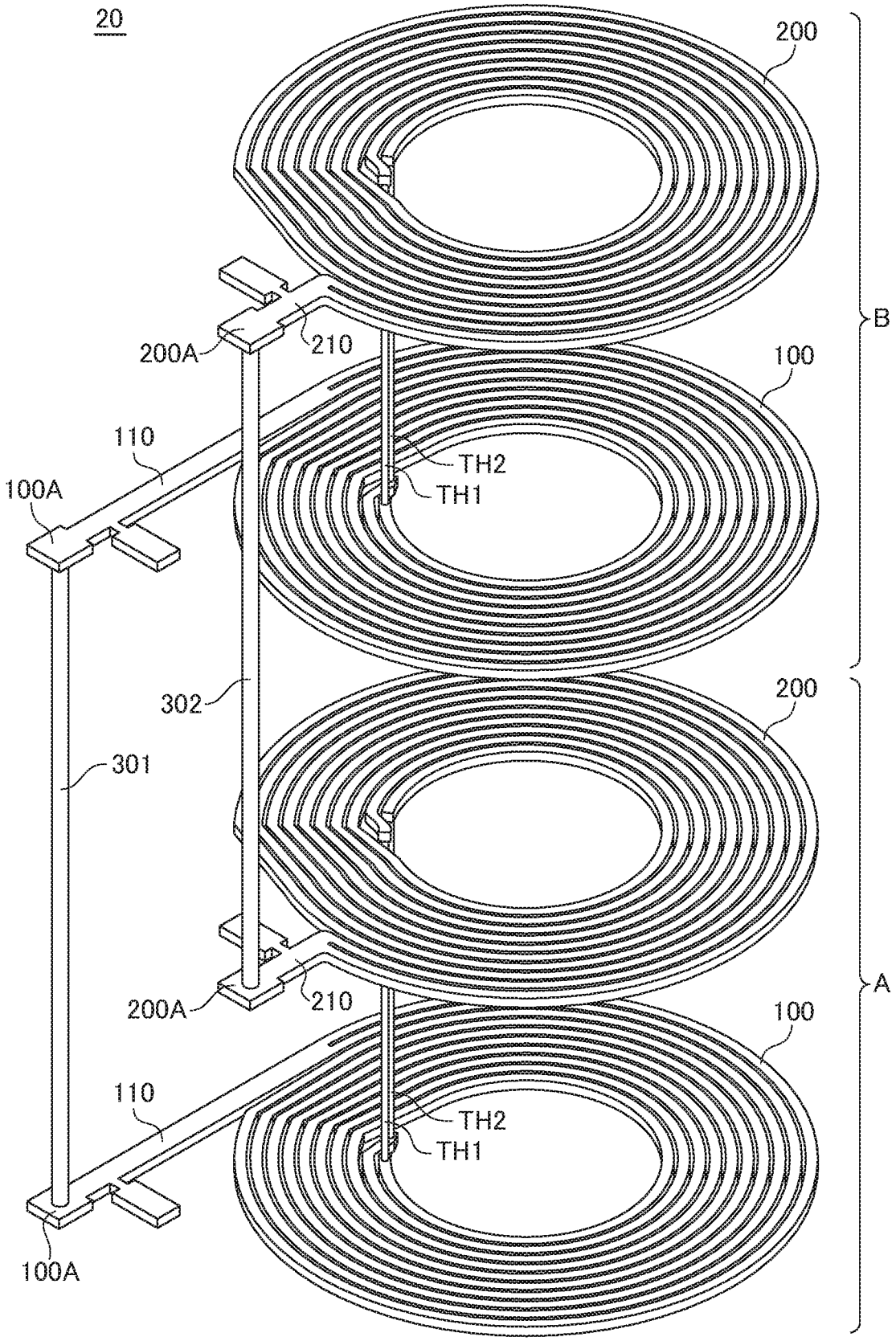
FIG. 8 is a schematic perspective view for explaining the structure of the main part of a coil component according to a second embodiment of the present invention.

FIG. 8 is a schematic perspective view for explaining the structure of the main part of a coil component 20 according to the second embodiment of the present invention.

As illustrated in FIG. 8, the coil component 20 according to the present embodiment has two sets (set A and set B) of the configurations each including the first coil part 100, second coil part 200, first through hole conductor TH1, and second through hole conductor TH2. The terminal electrode 100A included in the set A and terminal electrode 100A included in the set B are connected to each other through a connection conductor 301. The terminal electrode 200A included in the set A and the terminal electrode 200A included in the set B are connected to each other through a connection conductor 302.

Figure 9:
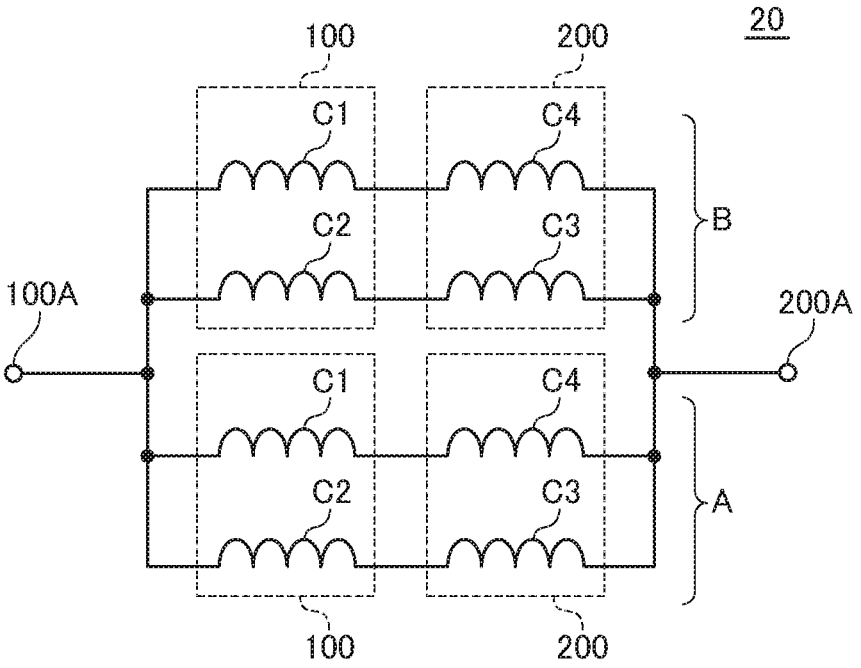
FIG. 9 is an equivalent circuit diagram of the coil component shown in FIG. 8.

With the above configuration, the set A and the set B are connected in parallel, so that as illustrated in FIG. 9, four sets of two serially-connected coils (C1 and C4 or C2 and C3) are connected in parallel. With this configuration, it is possible to further reduce DC resistance and AC resistance. The number of sets to be connected in parallel is not limited to two, but may be three or more. Further, the plurality of sets need not necessarily be connected in parallel, but may be connected in series.

Figure 10:
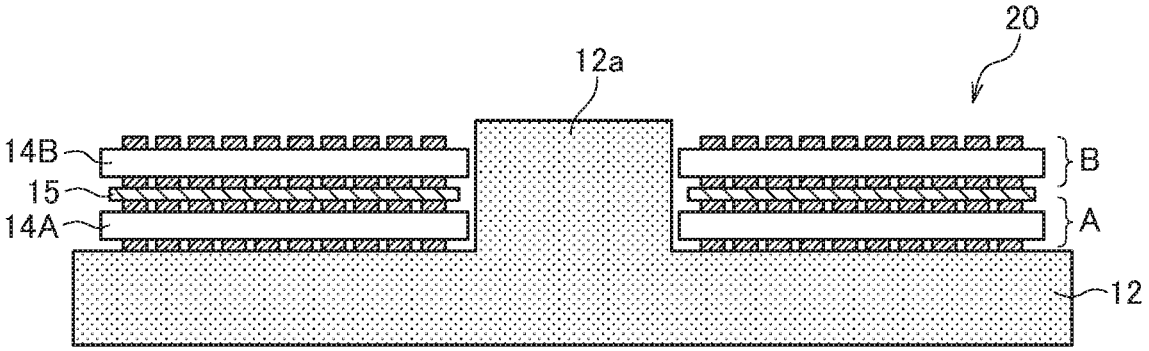
FIG. 10 is a cross-sectional view of a modification in which a magnetic member is added.

As illustrated in FIG. 10, the set A and the set B can be formed on different insulating films 14A and 14B. That is, the first coil part 100 and second coil part 200 constituting the set A may be formed on the front and back surfaces of the insulating film 14A, and the first coil part 100 and second coil part 200 constituting the set B may be formed on the front and back surfaces of the insulating film 14B. Then, the set A and the set B are laminated through an adhesive layer 15 which is, e.g., a double-sided adhesive tape and placed on the magnetic member 12 having the protruding part 12*a*, whereby high inductance can be obtained.

In the example of FIG. 8, the second coil part 200 constituting the set A and first coil part 100 constituting the set B directly face each other; however, arrangement between the set A and the set B is not limited to this. Thus, the first coil part 100 constituting the set A and the first coil part 100 constituting the set B may directly face each other, and the second coil part 200 constituting the set A and the second coil part 200 constituting the set B may directly face each other.

It is apparent that the present invention is not limited to the above embodiments, but may be modified and changed without departing from the scope and spirit of the invention.

For example, in the above embodiments, the first and second coil parts 100 and 200 are formed on the front and back surfaces of the insulating film 11 (14A, 14B); however, the present invention is not limited to this, and a configuration may be adopted, in which the first and second coil parts 100 and 200 are laminated on the same surface of a substrate with an intervention of an interlayer insulating film therebetween so as to separate them.

Further, in the above embodiments, all the turns constituting each of the first and second coil parts 100 and 200 are radially divided by the spiral slit; however, in the present invention, not all the turns need to be radially divided, and it is sufficient to radially divide at least the innermost turn (turn 105, turn 205) by the slit.

Further, in the above embodiments, the turns constituting each of the first and second coil parts 100 and 200 are each divided into two parts by one slit; however, the number of divisions of each turn is not limited to two. That is, each turn may be divided into three or more parts using two or more slits.

What is claimed is:

1. A coil component comprising:

an insulating film having first and second surfaces opposite to each other;

a first coil part formed on the first surface of the insulating film and spirally wound in a plurality of turns; and a second coil part formed on the second surface of the insulating film, laid so as to overlap the first coil part and spirally wound in a plurality of turns in a direction opposite to a winding direction of the first coil part, wherein each of the turns of the first coil part is radially divided into first and second conductor parts by a first spiral slit, and each of the turns of the second coil part is radially divided into third and fourth conductor parts by a second spiral slit, wherein the first conductor part is positioned radially inward of the second conductor part, and the third conductor part is positioned radially inward of the fourth conductor part, and wherein an inner peripheral end of the first conductor part is connected to an inner peripheral end of the fourth conductor part through a first through hole conductor formed so as to penetrate the insulating film, and an inner peripheral end of the second conductor part is connected to an inner peripheral end of the third conductor part through a second through hole conductor formed so as to penetrate the insulating film, wherein each of the first to fourth conductor parts has a circumferential area in which a radial position is not shifted and a transition area in which the radial position is shifted, and wherein line lengths of the transition areas of the first and second conductor parts decrease from an outer side of the first coil part to an inner side of the first coil part and line lengths of the transition areas of the third and fourth conductor parts decrease from an outer side of the second coil part to an inner side of the second coil part.

2. The coil component as claimed in claim 1, wherein the circumferential area of the first conductor part and the circumferential area of the third conductor part overlap each other, and the circumferential area of the second conductor part and the circumferential area of the fourth conductor part overlap each other.

3. The coil component as claimed in claim 1, further comprising a magnetic member having a protruding part, wherein the insulating film have a through hole formed at a portion corresponding to an inner diameter area of each of the first and second coil parts, and wherein the protruding part of the magnetic member is inserted through the through hole of the insulating film.

4. The coil component as claimed in claim 1, wherein a plurality of sets each including the first coil part and second coil part are provided, and wherein the sets are connected in parallel.

5. The coil component as claimed in claim 1, wherein each of the first and second surfaces of the insulating film is a flat.

6. The coil component as claimed in claim 5, wherein the insulating film comprises PET resin.

7. The coil component as claimed in claim 1, wherein a radial position of the second conductor shifts in a first transition section, wherein a radial position of the fourth conductor shifts in a second transition section, and wherein the first and second transition sections cross each other.

8. The coil component as claimed in claim 1, wherein a current direction at the inner peripheral end of the first conductor part flowing into the first through hole conductor is a same as a current direction at the inner peripheral end of the fourth conductor part flowing out from the first through hole conductor, and wherein a current direction at the inner peripheral end of the second conductor part flowing into the second through hole conductor is a same as a current direction at the inner peripheral end of the third conductor part flowing out from the second through hole conductor.

9. A coil component comprising:

an insulating film having first and second flat surfaces opposite to each other;

a first coil formed on the first flat surface of the insulating film, the first coil including first and second coil conductors extending in a circumferential direction, the second coil conductor being larger in a diameter than the first coil conductor;

a second coil formed on the second flat surface of the insulating film, the second coil including third and fourth coil conductors extending in a circumferential direction, the fourth coil conductor being larger in a diameter than the third coil conductor;

a first connection conductor connected between the first and fourth coil conductors so as to penetrate the insulating film; and a second connection conductor connected between the second and third coil conductors so as to penetrate the insulating film, wherein each of the first to fourth coil conductors has a circumferential area in which a radial position is not shifted and a transition area in which the radial position is shifted, and wherein line lengths of the transition areas of the first and second coil conductors decrease from an outer side of the first coil to an inner side of the first coil and line lengths of the transition areas of the third and fourth coil conductors decrease from an outer side of the second coil to an inner side of the second coil.

10. The coil component as claimed in claim 9, wherein the first coil has a first electrode electrically connected in common to the first and second coil conductors, and wherein the second coil has a second electrode electrically connected in common to the third and fourth coil conductors.

11. The coil component as claimed in claim 10, wherein the first electrode is positioned at an outermost end of the first coil, and wherein the second electrode is positioned at an outermost end of the second coil.

12. The coil component as claimed in claim 11, wherein the first and second connection conductors are positioned at innermost end of the first and second coils.

13. The coil component as claimed in claim 9, wherein the first and second planes are parallel with each other.

14. The coil component as claimed in claim 9, wherein the insulating film comprises PET resin.

15. A coil component comprising:

an insulating film having first and second flat surfaces opposite to each other;

a first coil conductor wound in a plurality of turns on the first flat surface of the insulating film;

a second coil conductor wound in a plurality of turns on the first flat surface of the insulating film so that the first and second coil conductors are concentrically wound;

a third coil conductor wound in a plurality of turns on the second flat surface of the insulating film;

a fourth coil conductor wound in a plurality of turns on the second flat surface of the insulating film so that the third and fourth coil conductors are concentrically wound;

a first electrode connected in common to outermost ends of the first and second coil conductors;

a second electrode connected in common to outermost ends of the third and fourth coil conductors;

a first connection conductor connected between innermost ends of the first and fourth coil conductors so as to penetrate the insulating film; and a second connection conductor connected between innermost ends of the second and third coil conductors so as to penetrate the insulating film, wherein each of the first to fourth coil conductors has a circumferential area in which a radial position is not shifted and a transition area in which the radial position is shifted, and wherein line lengths of the transition areas of the first to fourth coil conductors decrease from an outer side to an inner side of the first to fourth coil conductors, respectively.

16. The coil component as claimed in claim 15, wherein the first coil conductor has an innermost turn that is smaller in a diameter than an innermost turn of the second coil conductor, and wherein the third coil conductor has an innermost turn that is smaller in a diameter than an innermost turn of the fourth coil conductor.

17. The coil component as claimed in claim 16, wherein the first coil conductor has an outermost turn that is smaller in a diameter than an outermost turn of the second coil conductor, and wherein the third coil conductor has an outermost turn that is smaller in a diameter than an outermost turn of the fourth coil conductor.

18. The coil component as claimed in claim 15, wherein the insulating film comprises PET resin.

* * * * *